US005207614A

United States Patent [19]

Passadore

[11] Patent Number: 5,207,614

[45] Date of Patent: May 4, 1993

[54] CLEAN ROOM AIR SYSTEM

[75] Inventor: Albert M. Passadore, Aloha, Oreg.

[73] Assignee: Brod & McClung - Pace Company, Portland, Oreg.

[21] Appl. No.: 789,091

[22] Filed: Nov. 7, 1991

[51] Int. Cl.[5] ..... F24F 13/12

[52] U.S. Cl. ..... 454/298; 137/625.3; 137/625.33; 251/193; 454/324

[58] Field of Search ..... 454/298, 324; 251/193; 137/625.3, 625.33

[56] References Cited

U.S. PATENT DOCUMENTS

| | | | |
|---|---|---|---|
| 2,971,351 | 2/1961 | Webster . | |
| 3,308,741 | 3/1967 | Chambers | 454/298 |
| 3,440,946 | 4/1969 | Morrison . | |
| 3,465,666 | 9/1969 | Knab . | |
| 3,506,238 | 4/1970 | Bertels | 251/193 |
| 3,518,814 | 7/1970 | Maynard . | |
| 3,528,359 | 9/1970 | Sand | 454/324 |
| 3,986,850 | 10/1976 | Wilcox | 454/297 X |
| 4,253,769 | 3/1981 | Philipps . | |
| 4,407,187 | 10/1983 | Horney | 454/324 |
| 4,666,477 | 5/1987 | Lough | 454/298 X |
| 5,014,608 | 5/1991 | Benson | 454/187 |

FOREIGN PATENT DOCUMENTS

| | | |
|---|---|---|
| 764095 | 12/1956 | United Kingdom . |
| 2119440A | 11/1983 | United Kingdom . |

*Primary Examiner*—Robert G. Nilson
*Attorney, Agent, or Firm*—Klarquist, Sparkman, Campbell, Leigh & Whinston

[57] ABSTRACT

A clean room is supplied with air at a controllable velocity from a blower with a variable damper mechanism. The ceiling of the clean room is comprised of a plurality of panels of particulate filter material Associated with at least some of the panels are air dampers comprised of first, second, and third adjacent perforated plates. The first plate is fixed and the second plate is mounted for translational movement relative to the first. The third plate is interposed between the first and second plates as a gasket to reduce air flow between the plates. By moving the second plate relative to the first, the perforations therein are selectably opened or occluded, permitting the air passing through each panel to be regulated. Air flow through the room as a whole is controlled by the variable air flow feature of the blower.

8 Claims, 6 Drawing Sheets

CLEAN ROOM AIR SYSTEM

FILED OF THE INVENTION

The present invention relates to air handling equipment, and more particularly to a method and apparatus for controlling the airflow in a clean room.

BACKGROUND AND SUMMARY OF THE INVENTION

Clean rooms are increasingly used in industrial facilities for fabrication of precision electrical and mechanical components. Such rooms are typically pressurized so that contaminants, such as dust or the like, cannot enter when a door thereto is opened. The source of the pressurized air is usually a centrifugal fan mounted on the roof of the building that is operated in conjunction with a highly efficient particulate air filter.

In such applications, it is important that the air be moved at a controlled, low velocity. If the air is moved at a high velocity, it may stir up dust and other debris from within the room. Unfortunately, the air velocity through any given point in the ceiling is a strong function of that point's distance from the outlet of the fan. Further, the air velocity requirements may change with environmental changes or the use to which the room is put. A further requirement is that the air handling equipment should be quiet.

The prior art, while recognizing certain of these constraints, nonetheless has not provided a satisfactory air handling system for such clean room applications. It is an object of the present invention to provide such a satisfactory air handling system.

According to one embodiment of the present invention, a clean room is supplied with air at a controllable velocity from a blower with a variable damper mechanism. The ceiling of the room into which this air is to be routed is comprised of a plurality of panels of particulate filter material. Associated with at least some of said panels are air dampers comprised of first and second adjacent perforated plates. The first plate is fixed and the second plate is mounted for translational movement relative to the first. By moving the second plate relative to the first, the perforations therein are selectably opened or occluded, permitting the air passing through each panel to be regulated. Air flow through the room as a whole is controlled by the variable air flow feature of the blower.

In an alternative embodiment of the present invention, a third perforated plate is interposed between the first and second plates. The third plate serves as a gasket to limit air flow between the two plates and better seal the damper when the perforations are occluded. The seal formed by the third plate can be facilitated by introducing a slight upward bow in the second plate to thereby bias the second and third plates against the first plate.

The foregoing and additional objects, features and advantages of the present invention will be more readily apparent from the following detailed description, which proceeds with reference to the accompanying drawings.

DETAILED DESCRIPTION

To provide a comprehensive disclosure without unduly lengthening this specification, applicants incorporate by reference the specifications of U.S. Pat. Nos. 4,859,140, 4,666,477, 4,560,395, 4,135,850, 3,158,457, 3,638,404, 4,693,175 and 4,808,068, which provide background material relevant to the present invention.

Figure 1:
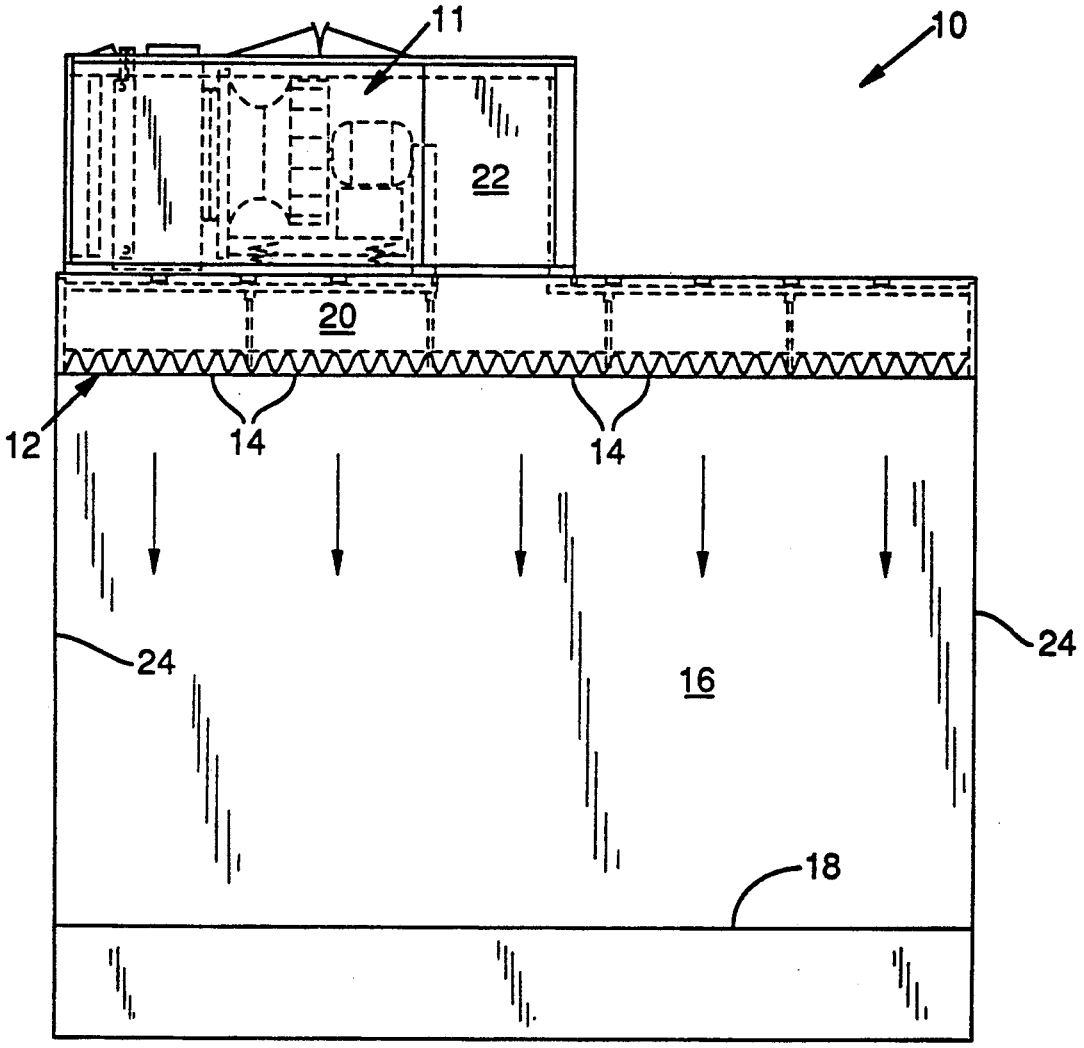
FIG. 1 is a sectional view of a clean room employing air balance dampers according to the present invention.
Figure 2:
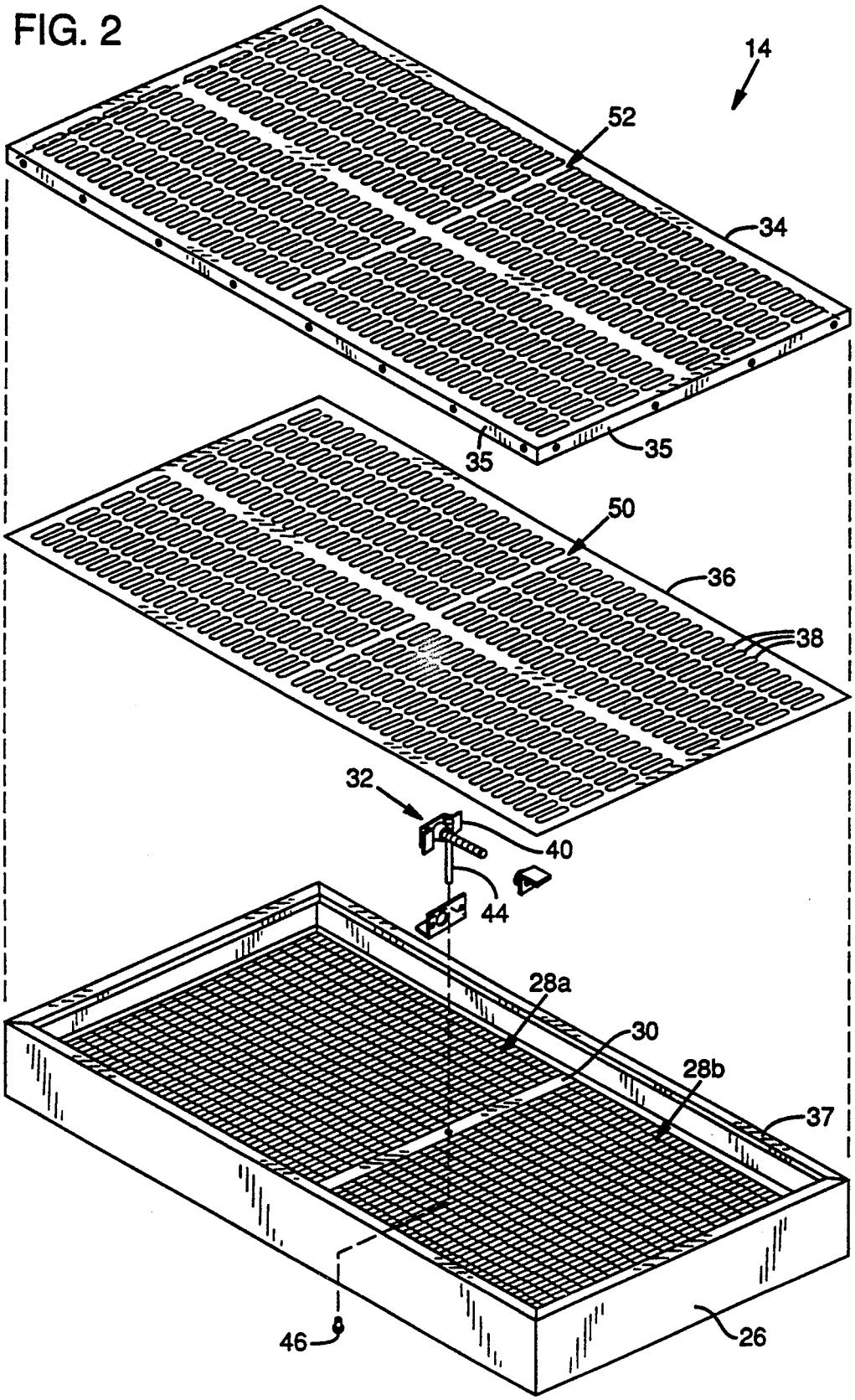
FIG. 2 is an exploded view of an air balance damper/filter assembly according to one embodiment of the present invention.
Figure 3:
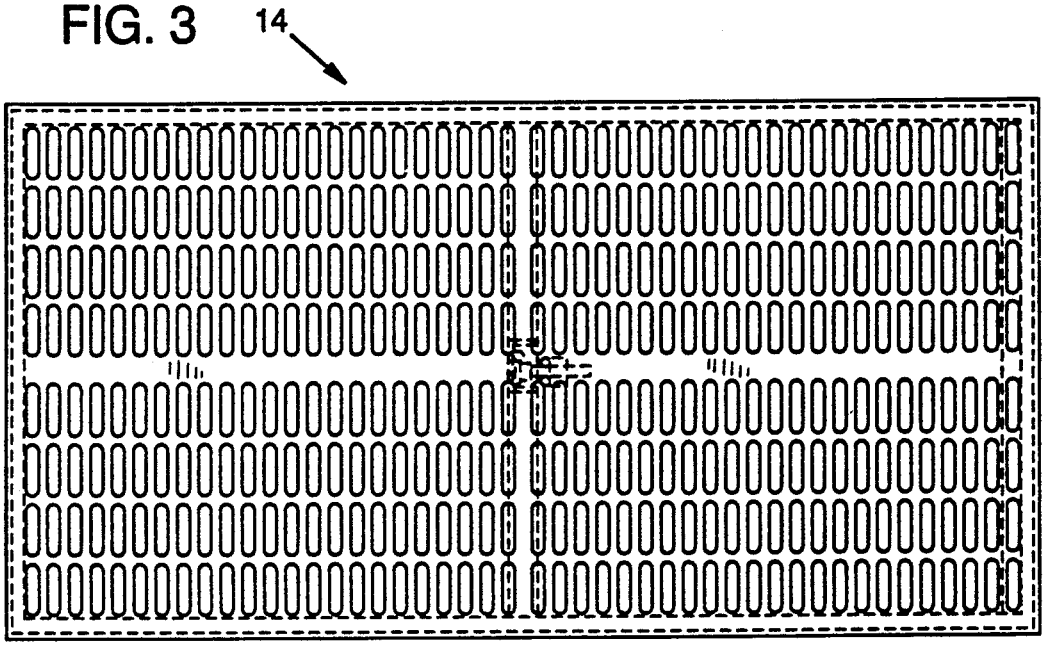
FIG. 3 is a top view of the damper of FIG. 2.
Figure 4:
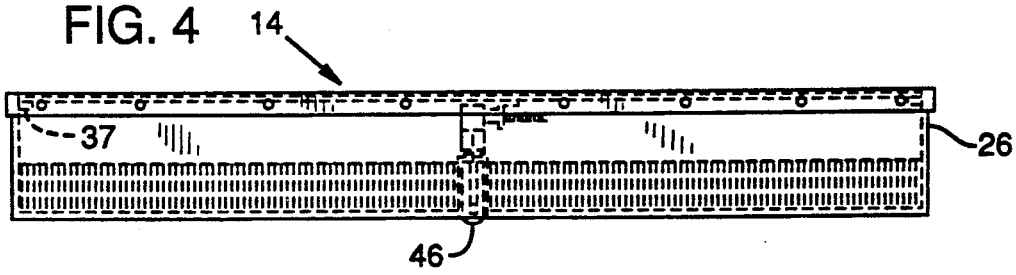
FIG. 4 is a side view of the damper of FIG. 2.

Referring to FIG. 1, an illustrative clean room 10 according to the present invention includes an air blower 11, a suspended ceiling 12 (comprised of a number of panels 14), a room 16 and a raised floor 18. The blower 11 is desirably one whose air flow can be remotely controlled, as illustrated in the above-referenced allowed application.

Above ceiling 12 is a plenum 20 through which air travels from the blower 11. It will be recognized that, if no equalization is provided, the air flow through the panels nearest the blower outlet 22 will be substantially higher than the air flow through the remote panels adjacent the walls 24 of the room.

The construction of panels 14 is illustrated in FIGS. 2–6. Basically, each panel comprises a frame 26 into which are mounted high efficiency particulate air filters 28*a* and 28*b*. In the illustrated embodiment, the frame dimensions are approximately 2 feet wide by 4 feet long by 6 inches high, although it will be recognized that other dimensions may of course be used.

Sealing the opening at the top of the frame is a first, stationary aluminum plate 34 which has flanges 35 extending downwardly therefrom that are attached to the upper outer periphery of the frame. Positioned immediately below this plate is a second, shorter aluminum plate 36 that is permitted to slide beneath the first on a lip 37 that extends about the top periphery of the frame. Both plates are perforated with a plurality of elongated slots 38. By sliding the second plate relative to the first, the openings therethrough can be selectively opened or occluded, thereby controlling the passage of air into the filter. The first plate 34 has unperforated margins 39 at the ends thereof so that openings at one end won't be unintentionally exposed when the second plate is slid towards the other end.

Included in frame 26 is a bracket 30 that bisects the lower portion of the frame and defines two regions into which the two filters 28*a*, 28*b* are received. Attached to bracket 26 is a control mechanism 32. This mechanism comprises a 90 worm drive gear assembly 40, best shown in FIGS. 5 and 6. A member 42 links this mechanism to the lower plate 36 and permits this plate to be controllably moved relative to the first. A drive shaft 44 extends downwardly from the worm drive through the bracket 30 and into a hollow 41 defined thereby. This hollow is closed on the lower surface of the panel 14 except for a hole through which the shaft 44 can be accessed and turned. This hole is normally plugged by a plug 46.

Figure 5:
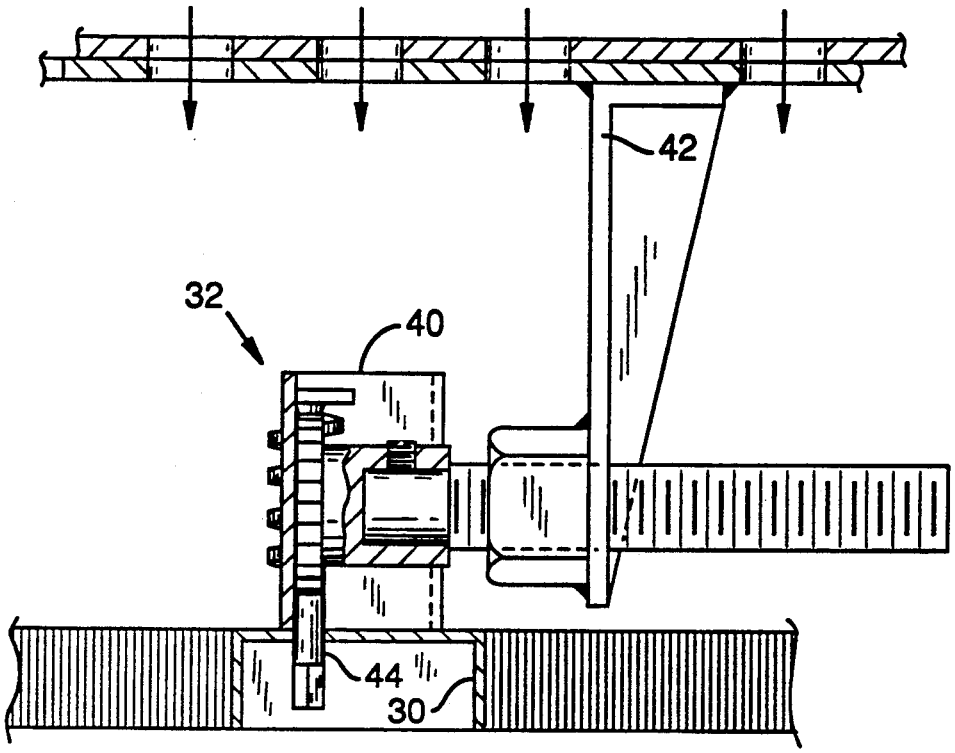
FIG. 5 is a fragmentary section view of the damper/filter assembly of FIG. 2 in the open position.
Figure 6:
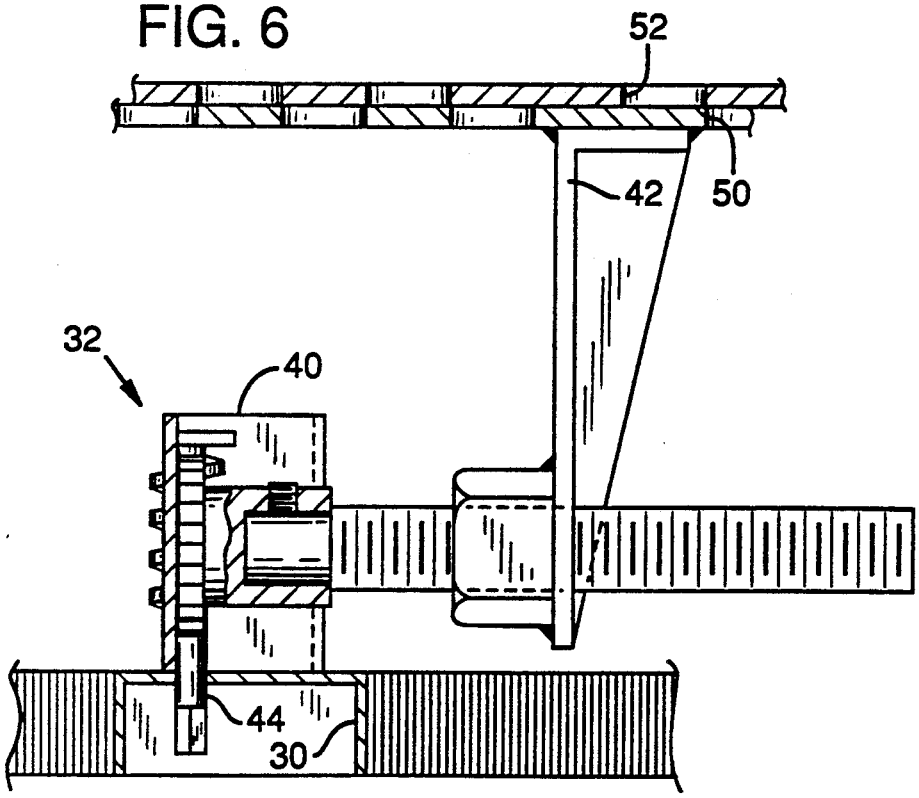
FIG. 6 is a fragmentary section view of the damper/filter assembly of FIG. 2 in the closed position.

In the embodiment of FIGS. 1–6, plates 34 and 36 are not perforated in the middle regions 52, 50 thereof. This lack of perforations provides an uninterrupted bearing surface between the two plates where they are urged together by member 42 (thereby preventing any droop that might form a gap between the plates). This is illustrated in FIGS. 5 and 6, in which it can be seen that the central portion 50 of the second plate 36 to which member 42 attaches is in continuous engagement with the corresponding central portion 52 of the first plate 34, regardless of whether the damper is in its open or occluded position.

Figure 7:
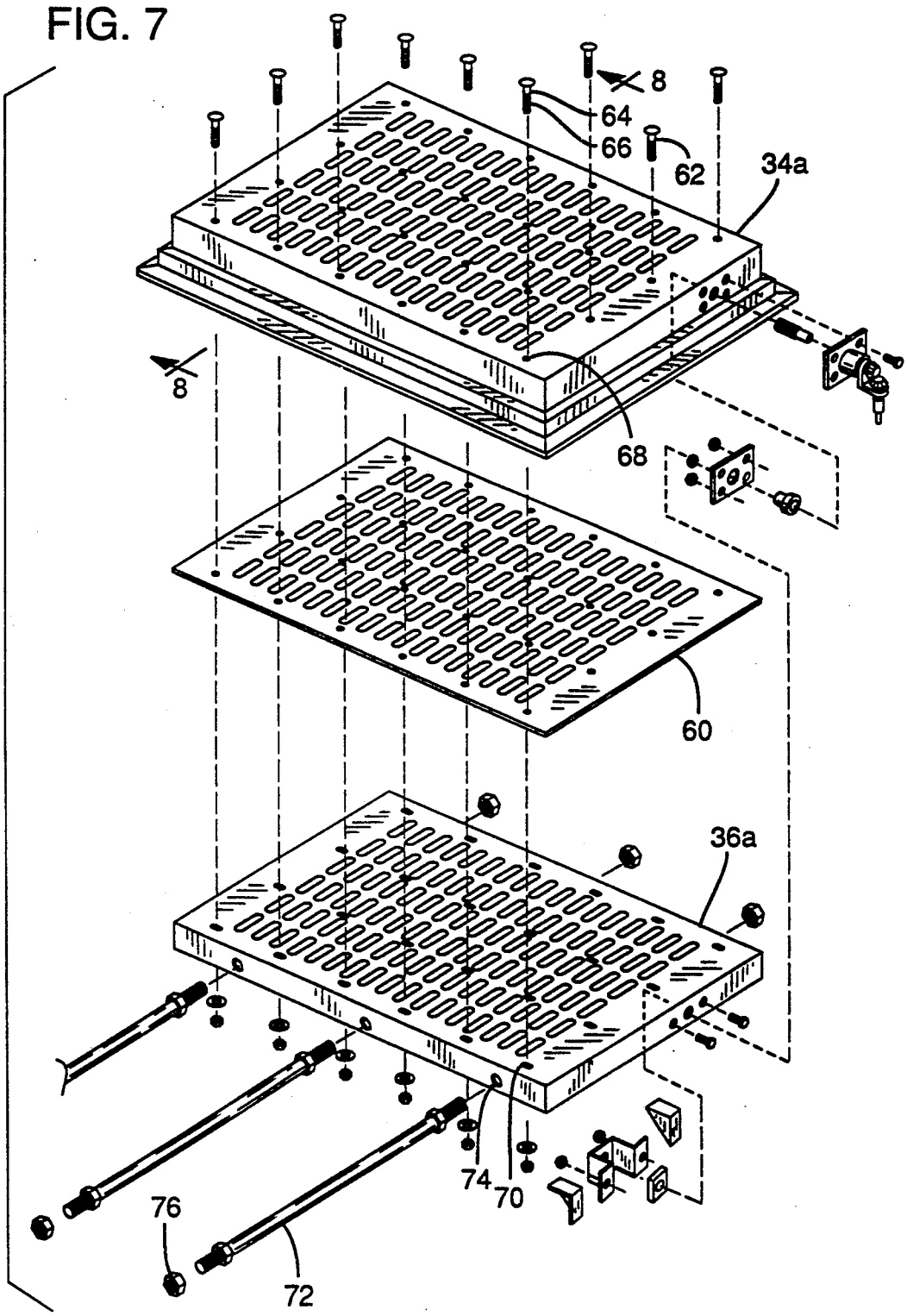
FIG. 7 is an exploded view of an alternative embodiment of the damper.
Figure 8:
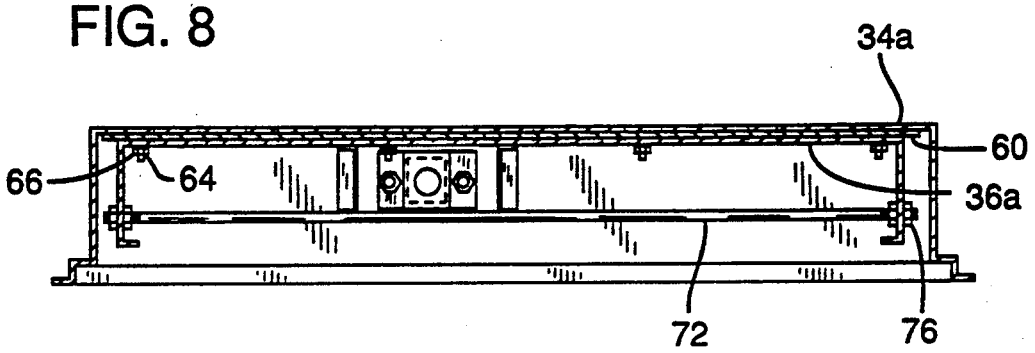
FIG. 8 is a cross sectional view of the damper illustrated in FIG. 7 taken along line 8—8.

In an alternative embodiment, illustrated in FIGS. 7 and 8, a third perforated plate 60 is interposed between the stationary plate 34*a* and movable plate 36*a*. Preferably, the third plate 60 is made of a gasket material, such as ultra high molecular weight polyethylene, such that it forms a seal which limits the flow of air between the first and second plates. This serves to reduce air leakage through the damper when in the closed position. The gasket may also serve as a lubricant to limit wear and provide free movement of the movable plate 36*a* relative to the stationary plate 34*a*.

In the embodiment illustrate in FIGS. 6 and 7, the third plate 60 and movable plate 36*a* are attached to the stationary plate 34*a* by means of a series of pemcert pins 62. As best seen in FIG. 8, each pin 62 has a shaft 64 and an expanded head 66. Each shaft 64 is fixed to the stationary plate 34*a* and extends through a hole 68 provided in the third plate 60 and a slot 70 provided in the movable plate 36*a*. The expanded head 66 is larger than the diameter of the hole 68 or the width of the slot 70 to thereby maintain the third plate 60 and the movable plate 36*a* in position on the shaft and adjacent the stationary plate 34*a*. In the embodiment of FIGS. 7 and 8, the each pin 62 can slide the length of the associated slot 70 to allow the movable plate 36*a* to be moved relative to the stationary plate 34*a*.

In the embodiment illustrated in FIGS. 7 and 8, the movable plate 36*a* is provided with three tension rods 72. Each tension rod 72 extends through a hole 74 provided on one side of the movable plate 36*a*, across the width of the movable plate 36*a*, and through a corresponding hole 74 on the opposite side of the second plate 36*a*. In the illustrated embodiment, a nut 76 is threaded onto each end of the tension rod 72 to abut the opposing sides of the movable plate 36*a*. In this manner, the nuts 76 can be tightened to place the rod 72 in tension and introduce a slight bow in the movable plate 36*a*. The bow serves to bias the movable plate 36*a* and the third plate 60 against the stationary plate 34*a* to further prevent air flow between the plates.

Figure 9:
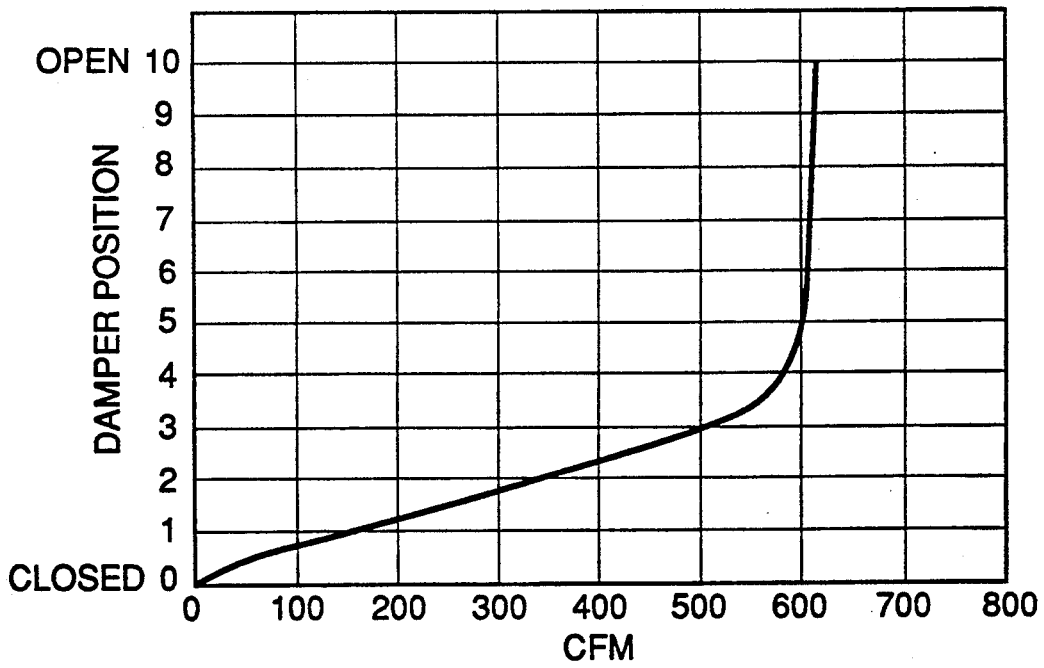
FIG. 9 is a plot of the air flow through the damper of FIG. 7 versus the position of the damper.

FIG. 9 is a graph showing the air flow rate through the damper illustrated in FIGS. 7 and 8 versus the position of damper. As illustrated, it has been found that the use of the third sheet and the tension members, in combination, can reduce leakage of the closed damper to virtually zero.

It will be recognized that the foregoing system advantageously permits control, by a single control, of all the air flow to the room, and further permits control, by a plurality of controls, of the air flow through each individual ceiling panel. The result is a flexible and efficient system that provides comprehensive control of a clean room's ventilation.

Having described and illustrated the principles of our invention with reference to preferred embodiments thereof, it will be apparent that the invention can be modified in arrangement and detail without departing from such principles. Accordingly, we claim as our invention all such modifications as may come within the scope and spirit of the following claims and equivalents thereto.

We claim:

1. A damper for a clean room ventilation system comprising:

a first plate provided with a plurality of perforations;

a second plate provided with a plurality of perforations, the second plate mounted to the first plate and movable between a first positions in which the perforations of the first plate are aligned with the perforations of the second plate and a second position in which the perforations of the first plate are not aligned with the perforations of the second plate; and a gasket plate provided with a plurality of perforation, the gasket plate interposed between the first and second plates to restrict the flow of air between the first and second plates.

2. The damper of claim 1 wherein the gasket plate is made of ultra high molecular weight polyethylene.

3. The damper of claim 1 further comprising tension means for creating a bow in the second plate.

4. A damper for ventilation system comprising:

a first plate having a hole;

a second plate mounted to the first plate and movable between a first position and a second position, the second plate obstructing the hole when in the first position;

a gasket plate interposed between the first plate and the second plate to limit the flow of air between the first and second plates; and a rod under tension which extends across one dimension of the second plate causing the second plate to bow in the direction of the first plate for biasing the second plate toward the first plate.

5. The damper of claim 4 wherein the gasket is formed from a resilient material.

6. The damper of claim 5 wherein the resilient material is ultra high molecular weight polyethylene.

7. A damper for a clean room ventilation system comprising:

a first plate having a plurality of apertures arranged in a predetermined pattern;

a second plate having a plurality of apertures arranged in the same predetermined pattern, the second plate mounted to the first plate and movable between a first position in which the apertures of the first plate and the second plate are aligned and a second position in which the apertures of the first plate are obstructed by the second plate;

a gasket plate formed of a resilient material interposed between the first plate and the second plate; and a rod extending across one dimension of the second plate, the rod being under tension so as to introduce a bow in the second plate and bias the second plate and the gasket plate toward the first plate.

8. A damper for a ventilation system comprising:

a first plate having a plurality of perforations;

a second plate mounted to the first plate and linearly movable between a first position and a second position, the second plate obstructing the plurality of perforations when in the first position;

a gasket plate interposed between the first plate and the second plate to limit the flow of air between the first and second plates;

biasing means for biasing the second plate toward the first plate; and means for moving the second plate linearly with respect to the first plate from the first position to the second position.

* * * * *

UNITED STATES PATENT AND TRADEMARK OFFICE

CERTIFICATE OF CORRECTION

PATENT NO. : 5,207,614
DATED : May 4, 1993
INVENTOR(S) : Albert M. Passadore

It is certified that error appears in the above-indentified patent and that said Letters Patent is hereby corrected as shown below:

On the Title page, item [57], col. 2, line 5, "material Associated" should read --material--.
Column 4, line 17, "first positions" should read--first position--.
Column 4, lines 23-24, "of perforation," should read --of perforations, --.
Column 4, line 31, 'for ventilation" should read --for a ventilation--.

Signed and Sealed this

Nineteenth Day of July, 1994

*Attest:*

Bruce Lehman

BRUCE LEHMAN

*Attesting Officer*

*Commissioner of Patents and Trademarks*